US005998342A

United States Patent [19]

Scoville, Jr. et al.

[11] Patent Number: 5,998,342

[45] Date of Patent: Dec. 7, 1999

[54] FOAMING ENZYME SPRAY CLEANING COMPOSITION AND METHOD OF DELIVERY

[75] Inventors: John R. Scoville, Jr., Parker; Inna A. Novicova, Aurora, both of Colo.

[73] Assignee: Cottrell International, LLC, Englewood, Colo.

[21] Appl. No.: 09/140,709

[22] Filed: Aug. 26, 1998

[51] Int. Cl.[6] ..... C11D 3/386; C11D 1/90

[52] U.S. Cl. ..... 510/160; 510/161; 510/162; 510/198; 510/199; 510/226; 510/258; 510/382; 510/392; 510/461; 510/530; 435/264; 134/42

[58] Field of Search ..... 510/160, 161, 510/162, 198, 199, 226, 258, 382, 461, 397, 530; 435/264; 134/42

[56] References Cited

U.S. PATENT DOCUMENTS

| | | | |
|---|---|---|---|
| 4,456,544 | 6/1984 | Lupova et al. | 252/174.12 |
| 4,749,511 | 6/1988 | Lad et al. | 252/174.12 |
| 4,994,200 | 2/1991 | Disch et al. | 252/106 |
| 5,173,207 | 12/1992 | Drapier et al. | 252/99 |
| 5,223,166 | 6/1993 | Disch et al. | 252/106 |
| 5,234,832 | 8/1993 | Disch et al. | 435/264 |
| 5,314,823 | 5/1994 | Nakagawa | 435/264 |
| 5,460,658 | 10/1995 | Nakagawa et al. | 134/42 |
| 5,462,607 | 10/1995 | Mestetsky et al. | 134/22.12 |
| 5,489,531 | 2/1996 | Benson | 435/264 |
| 5,576,278 | 11/1996 | Van Duzee et al. | 252/106 |
| 5,719,113 | 2/1998 | Fendler et al. | 510/382 |
| 5,767,054 | 6/1998 | Sprugel et al. | 510/383 |
| 5,810,944 | 9/1998 | Smitkowski et al. | 134/42 |

FOREIGN PATENT DOCUMENTS

| | | | |
|---|---|---|---|
| 60-89413 | 5/1985 | Japan | A61K 7/50 |
| 60-120810 | 6/1985 | Japan | A61K 7/50 |

*Primary Examiner*—Kery Fries

*Attorney, Agent, or Firm*—Townsend and Townsend and Crew, LLP

[57] ABSTRACT

This invention relates to a foaming enzyme composition and delivery method useful for the cleaning and maintenance of moist conditions of the surfaces of soiled instruments, utensils and other devices prior to final cleaning and/or sterilization. The aqueous composition preferably consists of a combination of: (1) an enzyme cleaning solution, (2) foam-building ingredients; (3) a corrosion inhibitor; and (4) an antimicrobial agent. The composition may be dispensed from a pump spray as a stable foam which covers the surfaces of the instrument to be cleaned, and remains on the surface of the instrument for at least 30 minutes, and preferably until the instruments are finally cleaned and sterilized. The composition and delivery method of the present invention is particularly useful for the pre-cleaning of complex medical instruments such as endoscopes.

6 Claims, No Drawings

FOAMING ENZYME SPRAY CLEANING COMPOSITION AND METHOD OF DELIVERY

BACKGROUND OF THE INVENTION

There exists in the prior art many aqueous cleaning solutions for industrial and commercial uses which contain a mixture of enzymes, as well as surfactants, detergents and other components. Enzymatic cleaning solutions have also been used in the past to clean various instruments, particularly medical instruments that have been soiled by exposure to materials and microorganisms present in the body cavities, tissues and blood of the surgical patient. Enzymes taught to be useful in such cleaning applications include one or more protease, amylase, lipase, cellulase and pectinase enzymes, which serve to attack or degrade organics, such as proteins, starches, fats, cellulose and pectins.

Medical and dental instruments are typically immersed in enzyme cleaners for the removal of gross soils prior to cleaning and disinfecting/sterilization. In order to effectively disinfect and/or sterilize these instruments, they must be scrupulously cleaned. The introduction of flexible glass fiber endoscopes and their growing use has created a challenge to effective cleaning. These instruments are complicated in design and contain a number of different materials. Typically the endoscopes utilize narrow lumens to transport air, liquids and surgical instruments to the interior of the human body, thereby making the instrument very difficult to clean.

Current methods of pre-cleaning medical instruments involve rinsing the instrument with water or cleaning solutions immediately after patient use. The instruments are then soaked in an enzyme solution until delivery to a central cleaning area where the instrument is disinfected and sterilized, usually by an autoclave. The enzyme soaking solution keeps the instrument moist in addition to digesting the proteinaceous, cellulosic, fat and other tissue adhering to the instrument surfaces. If the surfaces of the instrument become dry prior to cleaning, incomplete cleaning can result, which in turn may adversely impact subsequent disinfecting and/or sterilization.

There are several major drawbacks to using current immersion cleaning solutions to pre-clean complex modern medical instruments such as endoscopes. First of all, there is the tendency of the solution to splash during transport to the central cleaning area. Secondly, current enzymatic cleaning solutions typically lack antimicrobial agents to prevent growth of organisms introduced into the solution by the soiled instruments. In addition, continued use of a soaking solution tends to promote corrosion due to the variety of different materials utilized in the manufacture of the endoscopic instruments.

The present invention relates to a novel method and composition for pre-cleaning medical instruments and other devises that need to be kept moist to facilitate a final cleaning. In its preferred embodiments, a unique enzymatic cleaner is applied and maintained as a foam directly on the instrument surfaces without the need for immersion or heating.

The following are examples in the patent literature of several prior art cleaners and methods which utilize them:

Metesky et al, U.S. Pat. No. 5,462,607, Method of Cleaning Using A Foamed Liquid, teaches the use of an aqueous solution containing a surfactant and enzymes which is heated to create a foam via ebullition. This cleaner is useful for cleaning industrial equipment which has been soiled by lubricants.

Disch et al, U.S. Pat. No. 5,234,832, Process For Cleaning And Disinfecting Heat And Corrosion Sensitive Medical Instruments, teaches the use of a cleaning solution for endoscopes which contains a low-foaming nonionic surfactant, a proteolytic enzyme, a complexing agent and an aldehyde disinfectant in water having a specific hardness. The endoscope is immersed in the cleaning solution and heated to 55° C. to 65° C. for one to fifteen minutes, after which the instrument is rinsed and dried.

Disch et at, U.S. Pat. No. 5,233,166, Preparation And Processes For Cleaning And Disinfecting Endoscopes, is directed to a composition which is useful in the process described in U.S. Pat. No. 5,234,832.

Benson, U.S. Pat. No. 5,489,531, Combined Two Stage Method For Cleaning And Decontaminating Surgical Instruments, describes a method for cleaning and decontaminating soiled surgical instruments by immersing the instruments in an enzyme cleaning solution and then adding a germicidal detergent microbiological decontaminating solution.

Van Duzee et al., U.S.Pat. No. 5,576,278, Stable Liquid Enzyme Compositions And Methods of Use, teaches the cleaning of contact lenses by immersion in compositions containing opthalmically acceptable enzymes of high purity.

SUMMARY OF THE INVENTION

The present invention relates to a novel method of pre-cleaning medical and other instruments using an aqueous cleaning composition which creates a long-lasting foam on the surfaces of the instrument when dispensed from a trigger spray or aerosol container. In its broadest sense, the composition of the present invention comprises: (1) an enzyme cleaning solution; (2) foam-building ingredients; (3) a corrosion inhibitor; and (4) an antimicrobial agent.

The preferred method of the invention comprises the steps of: (a) dispensing the above-described cleaning composition from a spray or aerosol container to generate a foam; (b) covering the surfaces to be cleaned with the foam; (c) maintaining the foam on the surfaces, thereby keeping the surfaces moist, digesting organic materials present on the surfaces, preventing growth of microorganisms and inhibiting corrosion of the surfaces; and (d) rinsing the foam from the surfaces prior to final cleaning and sterilization.

An object of this invention is to provide a method whereby the surfaces of medical instruments are enzymatically cleaned without immersion, while imparting corrosion inhibiting and antimicrobial properties to the instrument being treated.

Another object of this invention is to provide an enzymatic cleaning solution which, when dispensed either by trigger sprayer or aerosol spray, creates a stable foam with the above described attributes which can be applied and maintained directly on the surfaces being cleaned.

Another object of the present invention is to develop a method and composition capable of maintaining the surface of a soiled instrument in a moist condition for at least 30 minutes while promoting cleaning and disinfecting of the instrument surfaces.

Another object of the present invention is to develop a method and composition capable of repeated use with delicate instruments without corrosion of the instrument surfaces.

Another objective of this invention is to utilize known properties of thick foam for a new application, i.e. the deep pre-cleaning and moistening of medical instruments and other surfaces immediately after use, e.g. after a surgical procedure, and prior to final cleaning.

DESCRIPTION OF THE PREFERRED EMBODIMENT

This invention provides a cleaning composition and a method of applying said composition as a stable foam to the surface of medical instruments, as well as other equipment or tools requiring the removal of organic soil from their surfaces. As used herein, "organic soil" means residues and contaminants present on the surface of the instrument or device which are subject to enzymatic digestion and removal. While the instant invention has particular application to endoscopes, the invention may also be used to clean other surgical, medical, or dental devices and equipment, or in fact any instruments, equipment or devices, e.g kitchen utensils, for any use where pre-cleaning organic soil from difficult surfaces and/or lumens is desired. In addition to endoscopes, examples of other medical instruments which may be suitable for the practice of the present invention include cardiovascular instruments, eye instruments, microsurgical instruments, neurologic and orthopedic instruments, laparoscopes, flexible fiberoptic scopes, bronchoscopes, cystoscopes and respiratory therapy equipment.

In its broadest aspects, the aqueous cleaning composition of the present invention comprises a unique combination of functional ingredients that heretofore have not been provided for cleaning. These functional ingredients comprise: (1) an enzyme cleaning solution, (2) foam-building ingredients; (3) a corrosion inhibitor; and (4) an antimicrobial agent. Such compositions are particularly useful and heretofore unknown for the difficult cleaning of complex medical instruments without immersion or heating.

The enzyme cleaning solution component of the composition contains enzymes in an amount sufficient to digest proteins, starches, and/or lipids and fat present on the metal and other surfaces of the instrument being cleaned. In preferred embodiments, the enzyme(s) are selected from the group consisting of protease, amylases, lipases, cellulases, pectinases, and mixtures thereof which are known to break down blood, body tissue and excretia commonly found on soiled medical instruments. The selected enzymes typically comprise about 0.05% to about 12% by weight of the total composition. The most preferred results in the practice of the present invention have been obtained using a combination of the protease enzymes and amylase enzymes marketed by Novo Nordics Co. under the trademarks Alcalase 25L DX and Termamyl 300L DX, respectively.

In addition, the enzyme cleaning solution component includes ingredients that stabilize and preserve the enzyme solution as well as help promote its effectiveness and use in accordance with the present invention. In preferred embodiments, the composition of the present invention comprises a water-miscible organic solvent in amount equal to about 0.5% to about 40% of the weight of the total composition. The organic solvent serves a variety of functions in addition to stabilizing and preserving the enzyme solution. For example, it helps to incorporate water insoluble components such as antimicrobial agents into the composition, serves as a corrosion inhibitor, helps dissolve fatty contaminants on the surfaces of the instrument being cleaned and aids in the penetration of the contaminant film on the instrument surfaces so that the enzyme cleaning components can be delivered to small cracks and crevices. Suitable organic solvents for the practice of this invention comprise water-miscible organic solvents with a boiling point above 120° C. and a low vapor pressure (i.e. below 0.07 mm Hg@20° C.), preferably a non-polar aliphatic hydrocarbon alcohol containing 2–12 carbon atoms. Organic solvents selected from the group consisting of propylene glycol, ethylene glycol, butylene glycol, and glycerol have been found to be particularly useful. Propylene glycol is a preferred organic solvent because of its preservation effect and compatibility with the enzyme components, its corrosion inhibition properties, its solubilization of the preferred anti-microbial agents, and its ability to decrease the evaporation rate of the composition (and thereby promote the stability of the foam structure).

In addition to the organic solvent, the enzyme cleaning solution component may also include additional ingredients which assure that the enzymes are stable and remain effective in the cleaning solution. Preferred compositions include about 0.001% to about 3.0% by weight of at least one borate or boric acid; most preferably boric acid and/or borax since these compounds not only act as a preservative for the enzyme solution but also serves as a convenient means of adjusting the pH of the composition, alone or in combination with other buffering agents such as citric acid. The desired pH of the composition is in the range of 7.0 to 8.0. The most preferred compositions may also include about 0.0001% to about 0.7% by weight of a source of calcium ion, preferably calcium chloride, which acts as an additional preservative for the enzymes in the solution.

The ingredients in the foam-building component are selected to enable the composition of the present invention to generate a thick and stable foam when sprayed from a trigger spray or aerosol spray container. Such spraying devices are commercially available and are well-known to one of ordinary skill in the art. The foam generated by the spray container is applied directly onto the surfaces of the medical instrument or utensil, and remains on the surfaces until rinsed just prior to final cleaning and disinfecting.

The quantities and characteristics of the ingredients comprising the foam-building component allow the cleaning composition of the present invention to be delivered onto and cover the surfaces of the instrument, or other utensil being cleaned, as a thick and stable foam. The composition must not only be formulated to accomplish its desired cleaning and moistening functions, but also retain a foam structure for the period of time typically required before the instruments are finally cleaned, sterilized and/or disinfected. In general, the composition of the present invention is formulated to maintain its foam structure on the instrument surfaces for at least 30 minutes, more preferably at least 90 minutes, and most preferably for 2 hours or more.

In general, the ingredients and methods of building foams are known to those skilled in the art. Foams are dense suspensions of gas bubbles uniformly dispersed in a smaller liquid volume. Without intending to be bound by any theory, it is believed that bubbles exist because of surface tension in the liquid phase, which is caused by the attraction of molecules to one another. In water and aqueous solutions, such as the composition of the present invention, this attraction results from an interaction between a hydrogen atom from one water molecule with the oxygen atom of another water molecule. Since the attraction between water molecules is strong, water has a high degree of surface tension and can support stable foam systems. In its preferred embodiments, certain high-foam surfactants which have molecules with long chains of carbon atoms are used in the foam-building component of the present invention. The long carbon chains, often referred to as "tails", are hydrophobic (i.e., do not like water), but on one end of this chain there is a group of atoms (the "head") that is hydrophilic (i.e. likes to be in water). As a result, these surfactants increase the surface tension of the aqueous solution and promote the formation of a film around the gas bubbles when the solution is aerated to form a foam. The film surrounding a surfactant bubble is composed of three layers: surfactant, water and surfactant. The surfactant is on the outside because of its hydrophobic character. The two layers of surfactant slow down the evaporation of the water layer and this action stabilizes the foam structure because when the water evaporates, the bubble collapses. By selecting a particular surfactant, or a certain combination of surfactants, thickeners and other foam-building ingredients in accordance with this invention, the enzymatic cleaning system can be readily dispensed from a conventional spray container as a foam onto the surface of the instruments being cleaned.

The thick foam covering the instrument surfaces serves to keep the instrument wet during the period of time that the instrument or utensil typically is awaiting final cleaning and disinfecting/sterilization. As previously indicated, compositions prepared in accordance with the preferred embodiments of the present invention will generate a foam that maintains the surfaces of the instrument in a moist condition for at least 30 to 90 minutes, and most preferably for 2 hours or more. The foam not only keeps the surfaces moist but also allows the cleaning process to begin immediately. For example, during the time that medical instruments are covered with the foam, the enzymes of the composition break down proteins present on the surfaces of the medical instrument, e.g. proteins in the form of blood and other body fluids, hydrocarbons and lipids. In addition, the surfactants and organic solvent help to disperse and remove organic and oil contamination, particularly from small lumens and joints. This same action can also be very useful for moistening and pre-cleaning kitchen utensils soiled with proteins, fats and starches in the form of food materials which are awaiting final cleaning in a dishwasher or sink.

The foam structure is a particularly efficient way to deliver the enzymatic cleaning composition to the surfaces of the instrument. The foam insulates the contacted surfaces from the outside environment and helps to maintain a warmer temperature, thereby preventing cooling caused by evaporation of the liquid. The maintenance of a suitable temperature is a major factor in maintaining enzymatic efficiency.

The foam is also intended to produce specific mechanical cleaning action through the gradual and successive collapsing of the foam bubbles. This collapse may be caused by evaporation of water and/or mechanical stresses exerted by the bubbles upon themselves. The collapsing bubbles create a shock effect accompanied by pressure on the surface. The created pressure forces cleaning solution deep into the instrument surfaces and into the difficult-to-access places. The pressure shock wave caused by the collapsing bubbles cause mechanical action to be applied to the surface, thus lifting soil from the instrument surface. This action increases the speed of reactions taking place during the cleaning process and increases the efficiency of the solution.

The method of the present invention is particularly convenient because it is carried out at ambient temperatures and does not require immersion of the instruments to be cleaned. In the practice of this invention, one need only spray a single composition at ambient temperatures (i.e. without heating) onto the instruments as they lay on a flat surface or in an appropriate container. Employing the method of this invention therefore dispenses with the need for any of the additional soaking and disinfecting solutions, heating equipment, and/or immersion vessels taught by the prior art.

The composition of the present invention comprises foam-building ingredients such as detergents, surfactants, emuslifiers and/or thickeners in an amount sufficient to generate and maintain a thick and stable foam when sprayed from a typical trigger sprayer or aerosol container.

Preferred embodiments of the invention comprise about 0.5% to about 25% by weight of at least one high-foam surfactant. As used herein, the term "high-foam surfactant" refers to known surfactants that facilitate the formation of a thick and stable foam structure when the solution is sprayed, and at the same time act as wetting agents to deliver the enzymes and other active ingredients to the instrument surfaces. Suitable high-foam surfactants are selected from the group consisting of diethanolamine derivatives (e.g. coconut fatty acid diethanolamine), lauric diethanolamide, and modified sulfonates, (e.g. modified sodium lauryl sulfonates and fluorosulfonates). A particularly preferred surfactant is a commercially available fluorosulfonate, Fluorad FC-100, manufactured and marketed by 3M Company, because this ingredient effectively acts as a detergent, thickener and foam builder in the practice of this invention. Another suitable high-foam surfactant is the sodium lauryl sulfate manufactured by Lonza Corporation under the brand name Carsonol SLS-S.

Preferred foam-building components may include a thickening agent, alone or in combination with one or more of the above surfactacts, in an amount sufficient to help generate and maintain the desired foam structure. Typically, the preferred compositions comprise about 0.5% to about 25% by weight of at least one thickener selected from the group consisting of betaine derivatives (i.e., methyl or ethyl cellulose), acrylic copolymers, and polyethylene glycol (PEG) derivatives. The most preferred thickener is the cocamidopropyl betaine marketed by Inolex Chemical Co. under the trademark Lexaine CG-30. Another suitable thickener is the PEG-18 glycerol oleate cocoate manufactured by Gold Schmidt Chemical Corp. and sold under the brand name Antil 171.

Although the organic solvents described above may also serve as the sole corrosion-inhibiting ingredient, certain additional corrosion inhibitors are preferably included in the composition to enhance its corrosion inhibiting properties. Typically, preferred embodiments contain about 0.05% to about 15% by weight of a corrosion inhibitor selected from the group consisting of mono-, di-, and tri-ethanolamine. Triethanolamine is the most preferred corrosion inhibitor because it also acts as a preservative for the enzyme solution, a chelating agent, and an emulsifier, as well as decreases the evaporation rate of the composition.

Compositions of the present invention also include an anti-microbial agent in an amount sufficient to prevent the growth of microorganisms on the instrument surfaces while covered by the foam. Anti-microbial agents suitable for this invention must be compatible with the enzymes in the composition. For example, quaternary ammonium salts are not acceptable anti-microbial agents because they are not compatible with enzymes. Typically, preferred compositions contain about 0.001% to about 3.0% by weight of at least one antimicrobial agent selected from the group consisting of substituted phenols, glutaraldehyde, and formaldehyde, most preferably o-benzyl-p-chlorophenol.

The compositions of the present invention may also include other ingredients known to one skilled in the art. For example, preferred compositions contain about 0.00% to about 0.5% of an odor suppressant, preferably Nodor FB4445, manufactured by Robert Koch Industries.

EXAMPLES

Example 1

The following example provides a detailed description of a preferred embodiment of the present invention, but is not intended to be in any way a limitation of the scope thereof:

A cleaning composition containing the following ingredients was prepared (all percentages are by weight of the final composition):

15.0% propylene glycol
0.10% o-benzyl-p-chlorophenol
1.0% triethanolamine
5.0% Fluorad FC-100 surfactant
2.5% Lexaine thickener
3.0% Alcalase protease enzyme
0.5% Termamyl amylase enzyme
0.27% boric acid
0.02% calcium chloride
0.1% Nodor odor suppressant
72.6% deionized water.

The following procedure was used to prepare the above cleaning composition:

20% of the total amount of propylene glycol was placed in a small vessel, to which the o-benzyl-p-chlorophenol ("OBCP")was added and mixed until thoroughly dissolved. The remaining 80% of the propylene glycol was placed into a primary mixing vessel and the dissolved OCBP was added and mixed to completely homogenize the solution. The Fluorad FC-100 and Lexaine CG-30 were then added to the solution sequentially, with slow mixing after each addition to avoid foam formation. The triethanolamine was then added, again with slow mixing to avoid foam formation.

The calcium chloride and boric acid were dissolved in a small recorded amount of de-ionized water in a separate container. Then, the remaining amount of de-ionized water required to complete the composition was added slowly with low speed mixing to form an aqueous solution. This aqueous solution was then added with mixing to the propylene glycol solution prepared above. The Alcalase 2.5 LDX enzyme and Termamyl LDX enzyme were added to the combined solutions and mixed slowly to prevent foam formation. Then, the Nodor odor suppressant was added and mixed slowly. The pH of the composition was tested and, if necessary, was adjusted to the range of 7.0 to 8.0 using citric acid or boric acid or sodium borate.

The above formulation and procedure produced a clear solution which was placed in a bottle with a trigger spray. The composition was sprayed onto soiled medical instruments after gross amounts of soil were removed from the instruments by rinsing. The instruments were placed in an appropriate container for transportation and an additional layer of foam was applied over the instruments. The resultant moderate foam was stable for more than 2 hours. Upon arrival at the central cleaning area, the instruments were rinsed and mechanically cleaned either by hand or by an instrument reprocessor. Once cleaned, the instruments were disinfected or sterilized using conventional means.

Example 2

A cleaning composition was prepared with the following ingredients using substantially the same procedure described in Example 1:

5.0% Lexaine CG-30 thickener
5.0% Antil 171 thickener
20.0% propylene glycol
3.0% Alcalase enzyme
1.0% Termamyl enzyme
0.33% citric acid
0.1% o-phenyl phenol
0.1% o-benzyl-p-chlorophenol
0.1% calcium chloride
65.47% deionized water The above formulation produced a clear solution which yielded a similar but less stable foam than the formulation of Example 1 when dispensed onto medical instruments from a bottle having a trigger sprayer.

Example 3

A cleaning composition was prepared with the following ingredients using substantially the same procedure described in Example 1:

5.0% Lexaine CG-300 thickener
5.0% Antil 171 thickener
20.0% propylene glycol
3.0% Alcalase enzyme
1.0% Termamyl enzyme
0.33% citric acid
0.1% o-phenyl phenol
0.1% calcium chloride
2.4% Carsonol SLS-S surfactant
2.0% Fluorad FL-100 surfactant
61.07% deionized water The above formulation produced a clear solution which yielded a foam that maintained its structure for 90 minutes when dispensed onto medical instruments from a bottle having a trigger sprayer.

What is claimed is:

1. A foaming enzyme cleaning composition comprising by weight about:

3.0% amylase enzyme;
0.5% protease enzyme;
15.0% propylene glycol;
0.27% boric acid;
0.02% calcium chloride;
5.0% fluorosulfonate high-foam surfactant;
2.5% cocamidopropyl betaine thickening agent;
0.10% o-benzyl-p-chlorophenol;
1.0% triethanolamine;
0.1% odor suppressant; and
72.6% deionized water.

2. A foaming enzyme cleaning composition suitable for cleaning medical and dental instruments comprising by weight: 0.5–12% of a combination of amylase and protease enzymes;

0.5–40% of an organic solvent selected from the group consisting of propylene glycol, ethylene glycol, butylene glycol and glycerol;
0.5–25% of a high-foam flourosulfonate surfactant;
0.5–25% of a betaine derivative thickening agent;
0.001–3% of at least one anti-microbial agent selected from the group consisting of substituted phenols, glutaraldehyde and formaldehyde;

0.05–15% of a corrosion inhibitor selected from the group consisting of mono-, di-, and tri-ethanolamine; and the balance deionized water.

3. A foaming enzyme cleaning composition according to claim 2 wherein the betaine derivative thickening agent is cocamidopropyl betaine.

4. A foaming enzyme cleaning composition according to claim 2 further comprising a polyethylene glycol derivative thickener.

5. A foaming enzyme cleaning composition according to claim 4 wherein said polyethylene glycol derivative thickener is glycerol oleate cocoate.

6. A foaming enzyme cleaning composition according to claim 2 further comprising:

0.001–3.0% boric acid and/or borax; and 0.001–0.7% calcium chloride.

* * * * *